US006089567A

United States Patent [19]

Yatsuhashi et al.

[11] Patent Number: 6,089,567

[45] Date of Patent: Jul. 18, 2000

[54] IMAGE FORMING APPARATUS

[75] Inventors: Kazuhiko Yatsuhashi, Abiko; Akihiro Toma, Ninomiya-machi, both of Japan

[73] Assignee: Canon Kabushiki Kaisha, Tokyo, Japan

[21] Appl. No.: 09/196,440

[22] Filed: Nov. 20, 1998

[30] Foreign Application Priority Data

Nov. 17, 1997 [JP] Japan ..... 9-326655

[51] Int. Cl.[7] ..... B65H 29/20

[52] U.S. Cl. ..... 271/314; 271/188; 271/209; 271/272

[58] Field of Search ..... 271/188, 314, 271/207, 209, 272

[56] References Cited

U.S. PATENT DOCUMENTS 5,094,660 3/1992 Okuzawa ..... 271/188 X
5,158,276 10/1992 Toma ..... 271/9
5,348,284 9/1994 Ishihama et al. ..... 271/160
5,904,350 5/1999 Creighton et al. ..... 271/188 X

FOREIGN PATENT DOCUMENTS 2144363 6/1990 Japan ..... 271/188
3227875 10/1991 Japan ..... 271/188

*Primary Examiner*—David H. Bollinger
*Attorney, Agent, or Firm*—Fitzpatrick, Cella, Harper & Scinto

[57] ABSTRACT

An image forming apparatus aims at eliminating a possibility of causing deterioration in conveying and scratching off toners on a recording medium by smoothly rotating a driven roller corresponding to rotations of a driving roller. Rubber rings spaced away in an axial direction from the driving roller are fitted to a shaft of a driven roller brought into contact with the driving roller. A record sheet conveyed with rotations of the driving roller rotates the rubber rings, whereby the driven roller can be surely rotated.

16 Claims, 9 Drawing Sheets

IMAGE FORMING APPARATUS

BACKGROUND OF THE INVENTION

1. Field of the Invention

The present invention relates to an image forming apparatus equipped with a sheet conveying device for conveying a sheet-like recording medium on which an image is formed.

2. Related Background Art

A conventional image forming apparatus is constructed as shown in, e.g., FIG. 17.

Referring to FIG. 17, record sheets defined as sheet-like recording mediums singly fed by a sheet feeding roller 11 out of a sheet supply cassette 10, are conveyed via a convey passageway A to a regist roller 12. When a front edge of a developed image formed on a photosensitive drum 13 arrives at a position of a transfer nip portion at which the photosensitive drum 13 is brought into contact with a transfer roller 14, a timing is taken so that the front edge of the record sheet is conveyed to the transfer nip portion by controlling rotations of the regist roller 12. Then, an image forming portion is constructed of the photosensitive drum 13 and the transfer roller 14.

The developed image on the photosensitive drum 13 is thus transferred onto the record sheet at the transfer nip portion, and thereafter the record sheet is separated from the photosensitive drum 13 and conveyed through a convey belt 15 to a fixing device 16. In this fixing device 16, the record sheet is sandwiched by pressure in between a heating member 17 and a pressurizing roller 18, and an unfixed image transferred onto the record sheet is fixed. Thereafter, the record sheet onto which the toner image has been fixed is discharged a couple of sheet discharge roller 19 via a convey passageway B to a tray 20 of a main body 1 of an image forming apparatus.

Incidentally, the couple of sheet discharge rollers 19 is constructed of a driving roller 19*a* composed of rubber, a driven roller 19*b* composed of resin which is rotatably supported by a holder 19*c*, and a spring 19*d* for pressing the driven roller 19*b* against the driving roller 19*a*.

The driven roller 19*b* of the couple of sheet discharge rollers 19 is, however, so constructed as to be pressed by a spring 19*d* into contact with the driving roller 19*a*, and rotationally driven by a frictional resistance against the record sheet. Therefore, if a frictional resistance (a conveying force) between the record sheet and the driven roller 19*b* is small, the driven roller 19*b* does not rotate, and consequently the problems given hereunder might arise.

1) If the frictional resistance between the record sheet and the driven roller 19*b* is small, the driven roller 19*b* is composed of a resinous material and is therefore unable to rotate due to its slippage. This might cause problems in which a convey deterioration such as a deterioration in discharging the sheet occurs, and the record sheets are not neatly staked on the tray 20.

2) Since the driven roller 19*b* does not rotate, it might happen that a toner image (a developer image) on the record sheet is scratched off.

3) Because of the driven roller 19*b* not smoothly rotating, the toners are adhered to the driven roller 19*b*, so that the toners on the driven roller 19*b* are then adhered to the record sheet when in a next image forming process, resulting in a state of being unable to obtain a well-formed record image.

SUMMARY OF THE INVENTION

It is a primary object of the present invention, which was devised to obviate the problems given above, to provide an image forming apparatus capable of eliminating possibilities of causing deteriorations in a conveying process and in a stacking process and of toners on a recording medium being scratched off.

To accomplish the above object, according to one aspect of the present invention, an image forming apparatus comprises an image forming portion for forming an image on a sheet-like recording medium, and a convey member for conveying the sheet-like recording medium discharged from the image forming portion. The convey member comprises a driving roller, a driven roller rotated while being pressed into contact with the driving roller, and an auxiliary rotary member, fitted to at least one end of a shaft of the driven roller and rotated upon a contact with the sheet-like recording medium conveyed with rotations of the driving roller, for transmitting the rotations thereof to the driven roller.

The auxiliary rotary member has a diameter larger than that of the driven roller and is constructed of a member exhibiting a large friction.

Based on the construction described above, the auxiliary rotary member fitted to at least one end of the shaft of the driven roller rotated while being pressed into contact with the driving roller, rotates upon the contact with the sheet-like recording medium conveyed with the rotations of the driving roller, and transmits the rotations to the driven roller.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

Figure 1:
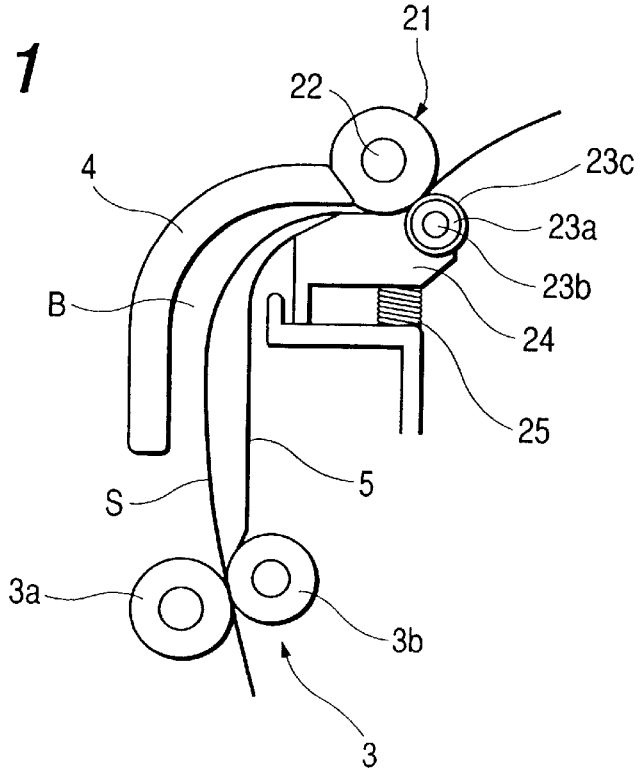
FIG. 1 is a front view showing a sheet-like recording medium conveying device in a first embodiment of the present invention.

Embodiments of the present invention will hereinafter be described in details with reference to FIGS. 1 to 4. Note that the same or equal components are marked with the like reference numerals in FIGS. 1 to 4, of which repetitive explanations are omitted.

First Embodiment

Disposed in the vicinity of a downstream-side of a fixing device, referring to FIGS. 1 to 4, are a couple of conveying rollers 3 including a roller 3*a* for guiding record sheets (sheet-like recording mediums) S onto which toners are fixed to a tray (a discharge portion), and a roller 3*b* driven following up this roller 3*a*. The record sheets S conveyed by the pair of conveying rollers 3 pass through a convey passageway B defined by a guide 4 and a frame 5 and is guided to a sheet discharge member (a convey member).

The sheet discharge member 21 serves to convey the record sheets S onto the tray. The sheet discharge member 21 includes a rubber driving roller 22 rotated by a driving force of a motor (not shown) provided in the main body, a resinous driven roller 23*a* rotating while coming into contact with the driving roller 22, and a holder 24 for rotatably supporting a shaft 23*b* of the driven roller 23*a*. The sheet discharge member 21 further includes high-friction members (exhibiting a higher friction coefficient than the driven roller), to be specific, rubber rotary members (rubber rings) 23*c*, 23*c* secured to both ends of the shaft 23*b* penetrating the holder 24 and each serving as an auxiliary rotary member having a slightly larger diameter than a diameter of the driven roller 23*a*, and a spring 25 for pressing the driven roller 23*a* against the driving roller 22 through the holder 24. In this case, the rubber rings 23*c*, 23*c* are in a non-contact state with the driving roller 22. Note that the rotary members 23*c* are secured to both ends of the shaft 23*b*, however, only one end of the shaft 23*b* may also be fitted with this rotary member 23*c*.

The record sheet S, onto which the toner image is fixed by the fixing device, is guided by the roller 3*a* and the roller 3*b* to the convey passageway B defined by the guide 4 and the frame 5, and subsequently discharged onto the tray by the sheet discharge member 21.

As described above, the sheet discharge member 21 in the first embodiment is constructed such that the rubber rings 23*c*, 23*c* are secured to both ends of the shaft 23*b* of the driven roller 23*a*, and therefore the record sheet S conveyed with rotations of the driving roller 22 make the rubber rings 23*c* rotate, whereby the driven roller 23 can be surely rotated. Namely, the rubber rings 23*c*, 23*c* are rotated by a driving force of the driving roller 22, a pressing force of the spring 25 and a frictional resistance of the record sheet S, and hence a frictional resistance against the record sheet S increases, with the result that the driven roller 23*a* smoothly rotates and a conveying force for the record sheet S enhances. Further, the driven roller 23*a* smoothly rotates, and therefore the toners on the record sheet S are neither scratched off nor adhered to the driven roller 23*a*.

Second Embodiment

Next, a second embodiment will be discussed with reference to FIGS. 5 to 7, 8A and 8B, 9A and 9B and 10A and 10B. Note that the same components to those in FIGS. 1 to 4 are marked with the like reference numerals in FIGS. 5 to 7, 8A and 8B, 9A and 9B, and 10A and 10B, of which repetitive explanations are omitted.

Figure 3:
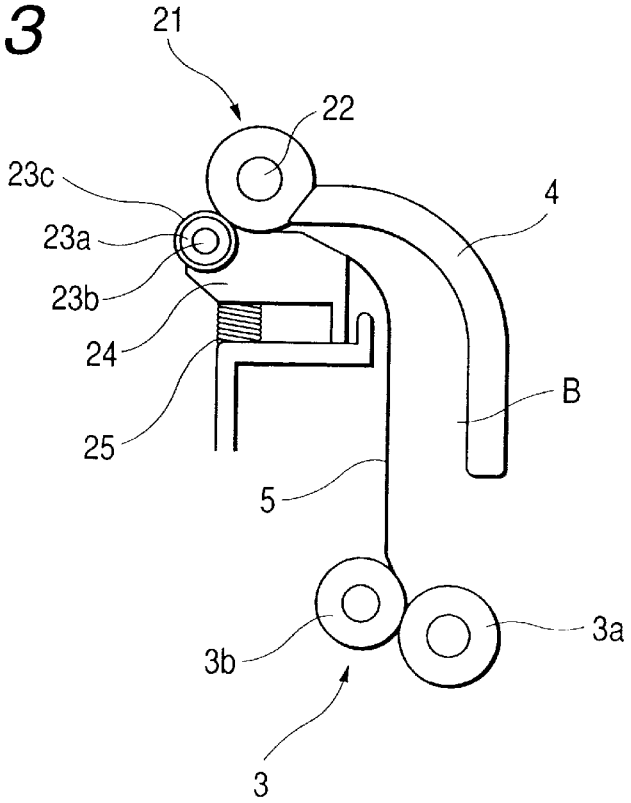
FIG. 3 is a rear view of the conveying device in FIG. 1.
Figure 2:
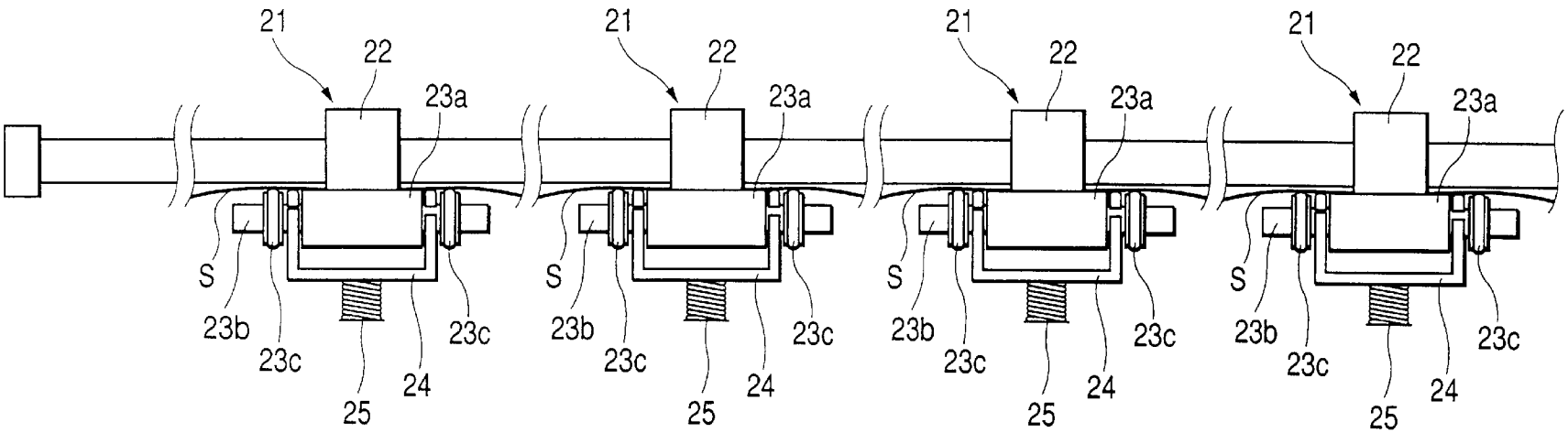
FIG. 2 is a side view showing the principal portion of the conveying device in FIG. 1.
Figure 4:
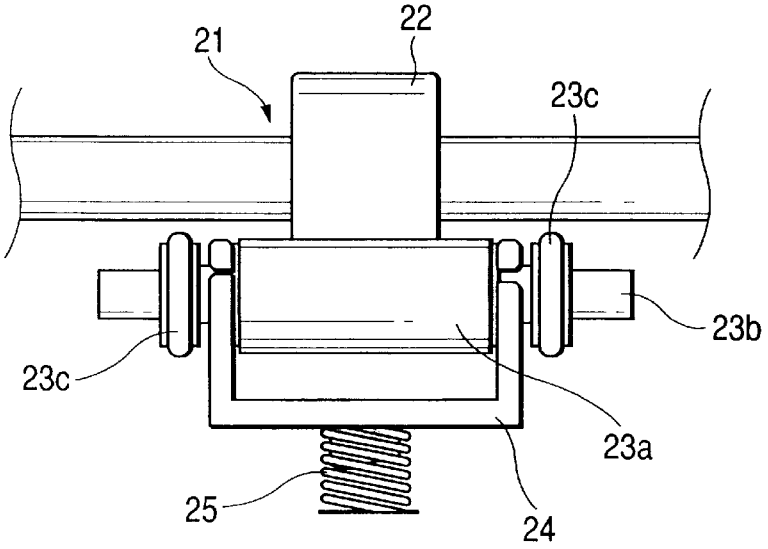
FIG. 4 is a side view showing the principal portion of the conveying device shown in FIG. 2.
Figure 5:
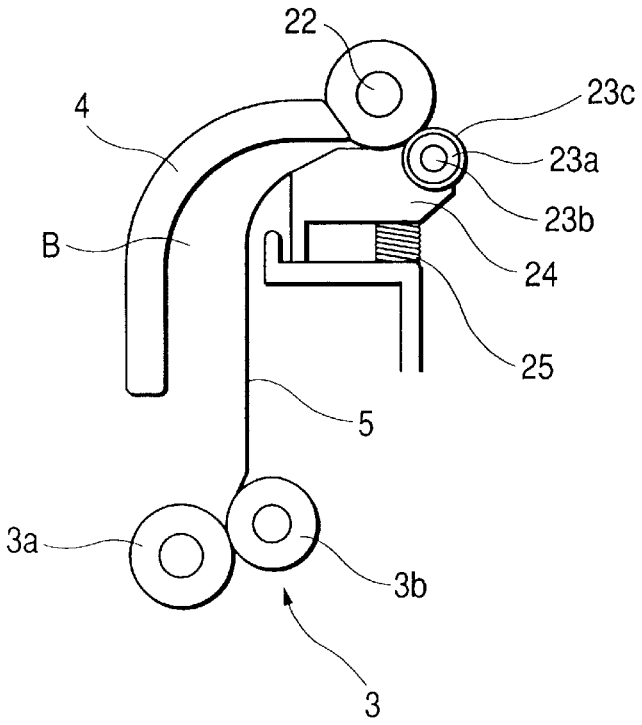
FIG. 5 is a front view showing the sheet-like recording medium conveying device in a second embodiment of the present invention.
Figure 6:
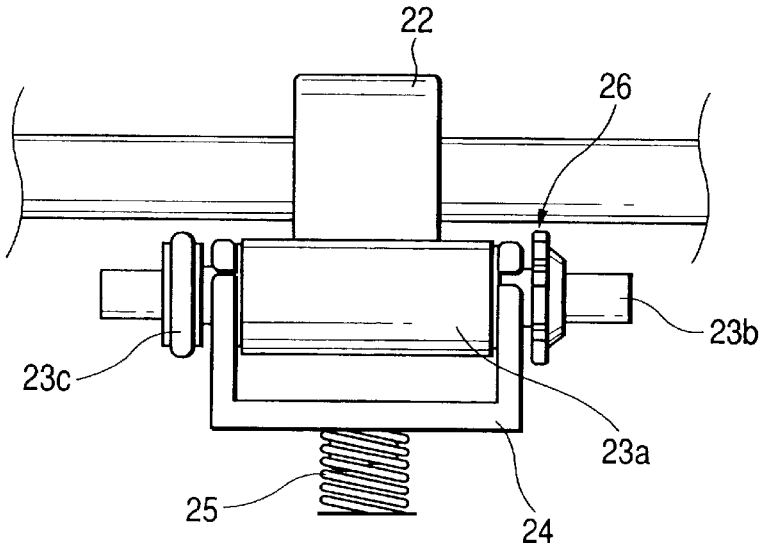
FIG. 6 is a side view showing the principal portion of the conveying device in FIG. 5.
Figure 7:
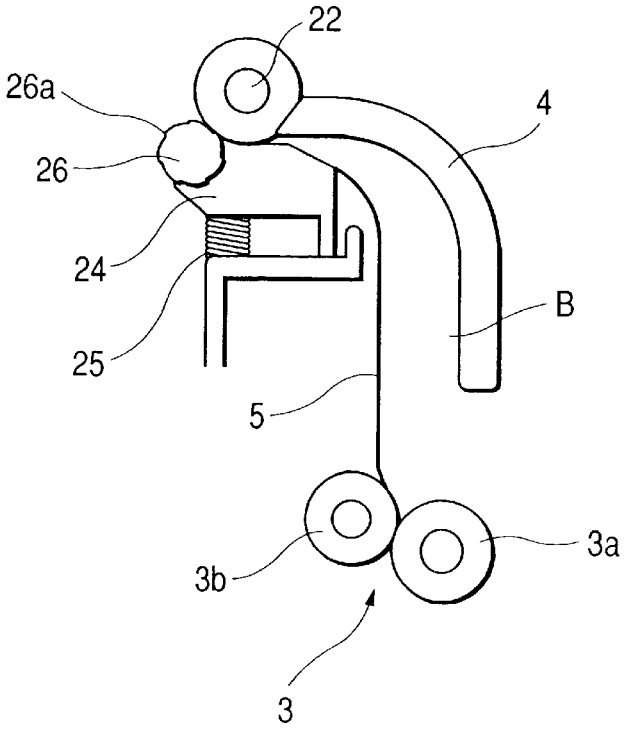
FIG. 7 is a rear view of the conveying device in FIG. 5.
Figure 8A:
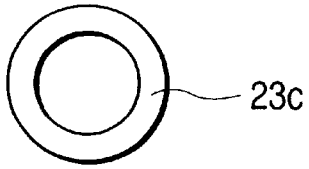
FIGS. 8A and 8B are side views each showing a configurational example of a rubber ring in the second embodiment.
Figure 8B:
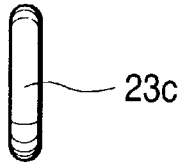
Figure 9A:
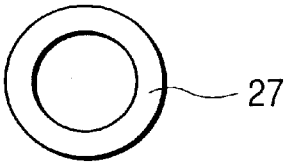
FIGS. 9A and 9B are side views each showing a configurational example of the rubber ring in the second embodiment.
Figure 9B:
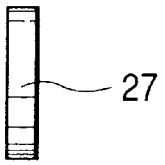
Figure 10A:
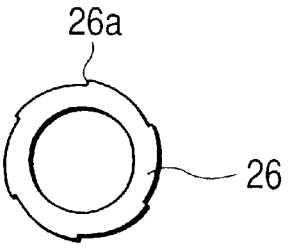
FIGS. 10A and 10B are side views each showing a configurational example of the rubber ring in the second embodiment.
Figure 10B:
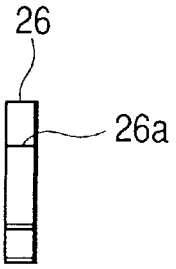

The rubber ring 23*c* in the first embodiment takes the configuration of the O-ring as shown in FIGS. 3 and 4. The configuration of the rubber ring according to the present invention is not limited to the shape of the O-ring. For example, as illustrated in FIGS. 5 and 10A and 10B, a rubber ring 26 as a rubber rotary member attached to one end of the shaft 23*b* of the driven roller 23*a* may assume such a configuration as to have a circular serrated hooking portion (a rugged portion) 26*a*, and, as shown in FIGS. 9A and 9B, may take a configuration of a rubber ring 27 which is angular in section and serves as an auxiliary rotary member. The hooking portion 26*a* is capable of increasing an ejecting force given to the record sheet to be discharged. Further, the angular ring 27 has a larger contact area with the record sheet and is therefore capable of obtaining a large rotational force from the record sheet.

Thus, the sheet discharge member 21 in the second embodiment is constructed such that the rubber ring 26 formed with the hooking portion 26*a* or the sectionally angular ring 27 is attached to one end of the shaft 23*b* of the driven roller 23*a*, and the O-shaped rubber ring 23*c* is fitted to the other end thereof. The record sheet S conveyed with the rotations of the driving roller 22 is capable of surely rotating the driven roller 23*a* by rotating the rubber ring 23*c* and the rubber ring 26 including the hooking portion 26*a*, or the sectionally angular ring 27. That is, the rubber ring 23*c* and the rubber ring 26 having the hooking portion 26*a* or the sectionally angular ring 27 are rotated by the driving force of the driving roller 22, the pressing force of the spring 25 and the frictional resistance of the record sheet S, and therefore the frictional resistance against the record sheet S increases, with the result that the driven roller 23*a* smoothly rotates and the conveying force of the record sheet is enhanced. Further, the driven roller 23*a* smoothly rotates, and hence the toners on the record sheet S are neither scratched off nor adhered to the driven roller 23*a*.

Third Embodiment

Figure 11:
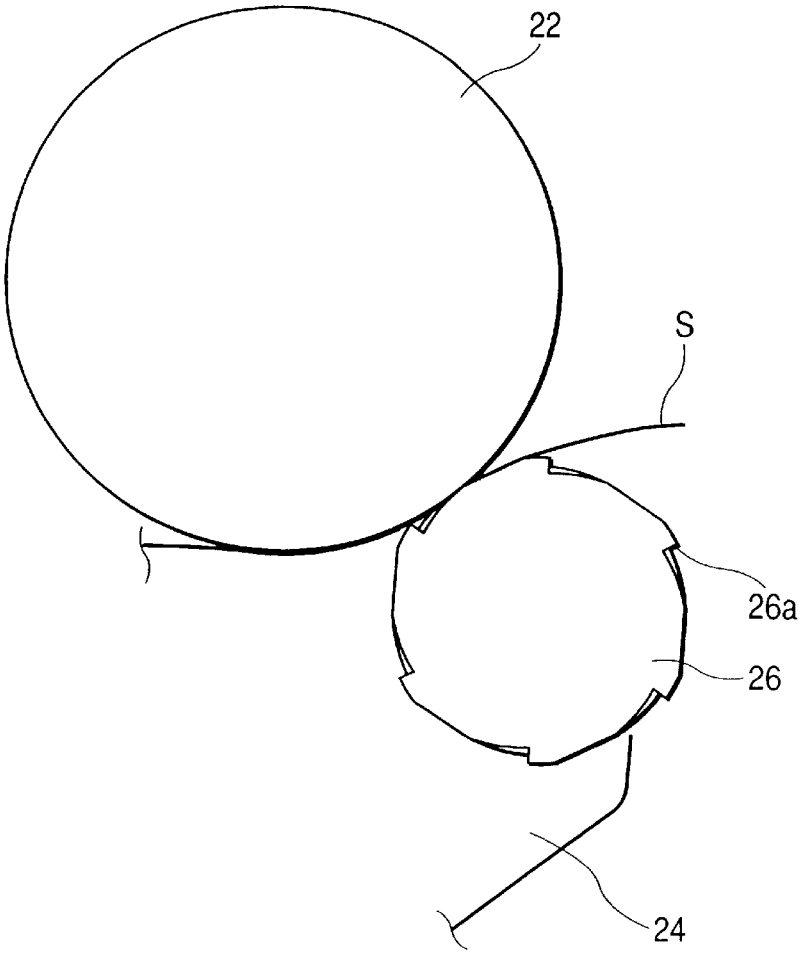
FIG. 11 is a front view illustrating a sheet discharge member in a third embodiment of the present invention.
Figure 12:
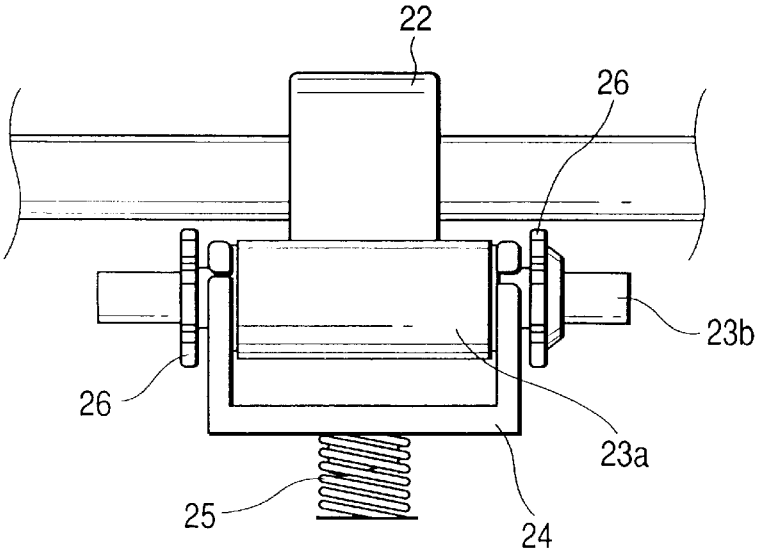
FIG. 12 is a side view showing the principal portion of the sheet-like recording medium conveying device in the third embodiment.
Figure 13:
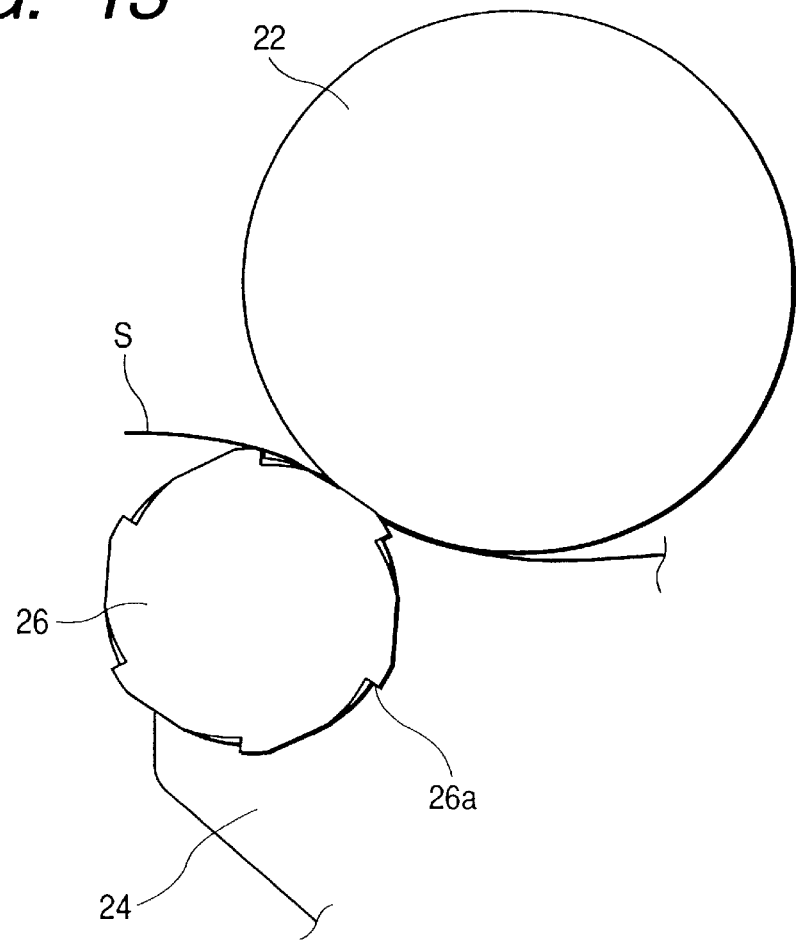
FIG. 13 is a rear view of the sheet discharge member in FIG. 11.

Next, a third embodiment will be discussed with reference to FIGS. 11 to 13. Note that the same components to those in FIGS. 1 to 4 are marked with the like reference numerals in FIGS. 11 to 13, of which repetitive explanations are omitted.

In the second embodiment, the rubber ring 26 having the hooking portion 26*a* or the sectionally angular ring 27 is fitted to one end of the shaft 23*b* of the driven roller 23*a*, and the O-shaped rubber ring 23*c* is fitted to the other end thereof. The rubber ring secured to the shaft 23*b* of the driven roller 23*a* according to the present invention is not, however, confined to the one described in the embodiment discussed above. For example, as shown in FIGS. 11 and 13, the rubber rings 26 formed with the hooking portions 26*a* may also be fitted to both ends of the shaft 23*b* of the driven roller 23*a*. In this case, the hooking portion 26*a* of the rubber ring 26 of the shaft 23*b* provided at one end thereof is formed in the forward direction, while the hooking portion 26*a* of the rubber ring 26 of the shaft 23*b* at the other end thereof is formed in the opposite direction.

As discussed above, the sheet discharge member 21 in the third embodiment is constructed such that the hooking portions 26*a* of the rubber rings 26 fitted to both ends of of the shaft 23*b* of the driven roller 23*a* are formed in the directions opposite to each other. Therefore, the record sheet S conveyed with the rotations of the driving roller 22 rotates the rubber ring 26 having the hooking portion 26*a*, whereby the driven roller 23*a* can be surely rotated. Namely, the hooking portion 26*a* of the rubber ring 26 is engaged with and thus gripped on the rugged portion of the record sheet S by the driving force of the driving roller 22, the pressing force of the spring 25 and the frictional resistance of the record sheet S, and the frictional force of the driven roller 23*a* against the record sheet S is thereby increased enough to cause the smooth rotations of the driven roller 23*a* and enhance the conveying force for the record sheet S. Further, since the driven roller 23*a* smoothly rotates, the toners on the record sheet S are neither scratched off nor adhered to the driven roller 23*a*.

Fourth Embodiment

Figure 14:
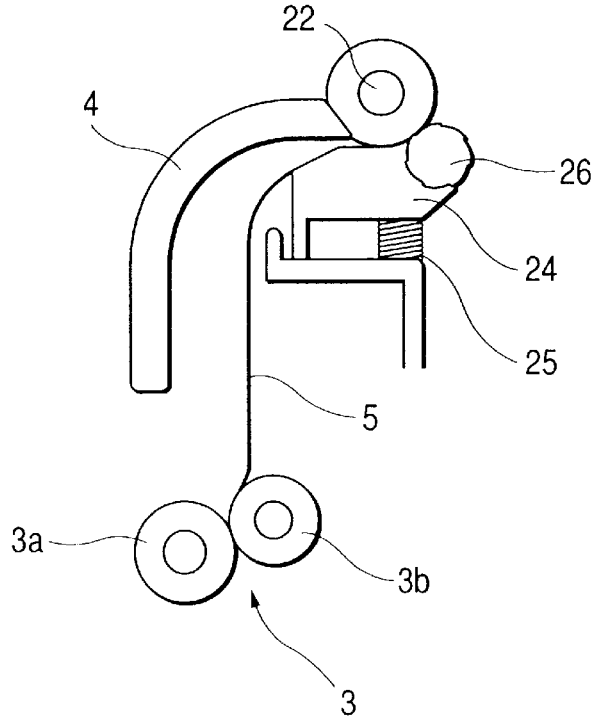
FIG. 14 is a front view showing the sheet-like recording medium conveying device in a fourth embodiment of the present invention.

Next, a fourth embodiment will be discussed with reference to FIGS. 14 to 16. Note that the same components to those in FIGS. 1 to 4 are marked with the like reference numerals in FIGS. 14 to 16, of which repetitive explanations are omitted.

Figure 15:
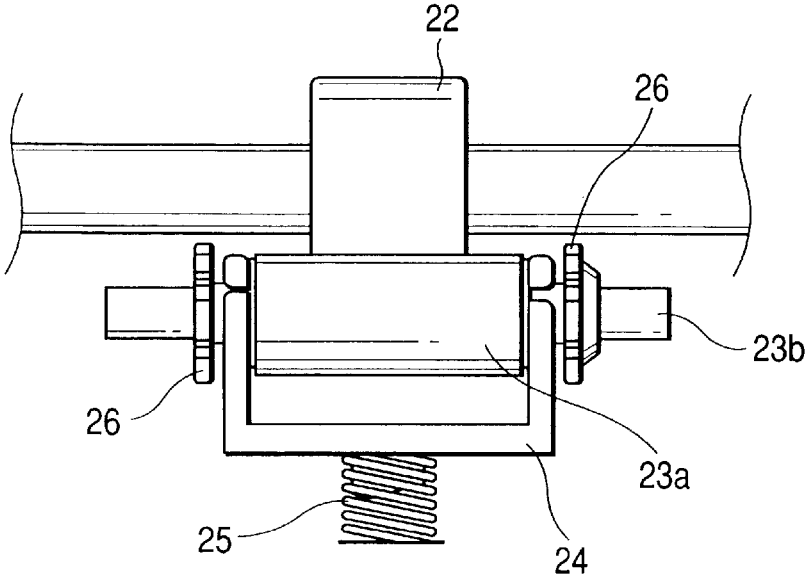
FIG. 15 is a side view showing the principal portion of the conveying device in FIG. 14.
Figure 16:
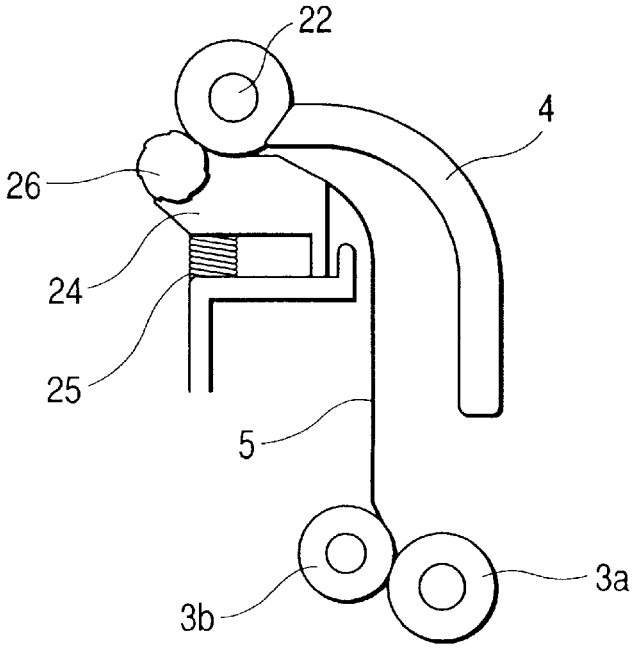
FIG. 16 is a rear view of the conveying device in FIG. 14.
Figure 17:
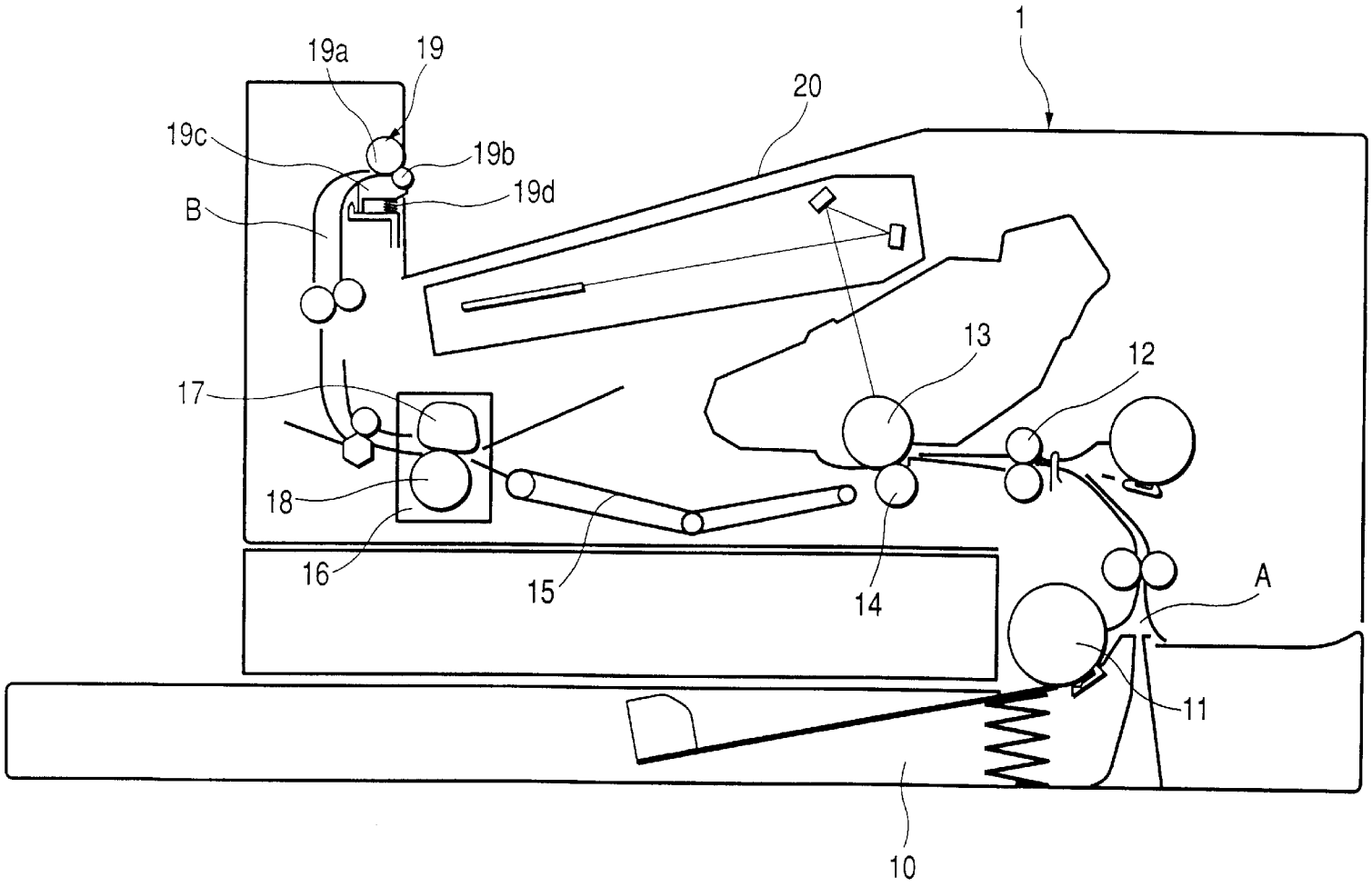
FIG. 17 PRIOR ART
FIG. 17 is a view schematically showing a conventional image forming apparatus.

In the fourth embodiment, as illustrated in FIG. 15, the rubber rings 26 formed with the hooking portions 26*a* formed in the directions opposite to each other are fitted to both ends of the shaft 23*b* of the driven roller 23*a*. A material of one rubber ring 26 exhibits a higher frictional coefficient than a material of the other rubber ring 26.

Thus, in the fourth embodiment, the sheet discharge member 21 is constructed in such a manner that the hooking portions 26*a* of the rubber rings 26 fitted to both ends of the shaft 23*b* of the driven roller 23*a* are formed in the directions opposite to each other, and the material of one rubber ring 26 exhibits the higher frictional coefficient than the material of the other rubber ring 26. Therefore, the record sheet S conveyed with the rotations of the driving roller 22 rotates the rubber ring 26 having the hooking portion 26*a*, whereby the driven roller 23*a* can be surely rotated. Namely, the hooking portion 26*a* of the rubber ring 26 is engaged with and thus gripped on the rugged portion of the record sheet S by the driving force of the driving roller 22, the pressing force of the spring 25 and the frictional resistance of the record sheet S. Thus, the frictional force of the driven roller 23*a* against the record sheet S is increased enough to cause the smooth rotations of the driven roller 23*a* and enhance the conveying force for the record sheet S. Further, since the driven roller 23*a* smoothly rotates, the toners on the record sheet S are neither scratched off nor adhered to the driven roller 23*a*.

As discussed above, according to the present invention, in the convey member, the sheet-like recording medium conveyed with the rotations of the driving roller rotates the auxiliary rotary member fitted to at least one end of the shaft of the driven roller rotated while being pressed into contact with the driving roller, thereby transmitting the rotations to the driven roller. It therefore follows that the sheet-like recording medium conveyed with the rotations of the driving roller rotates the auxiliary rotary member and the driven roller smoothly rotates, thereby preventing deterioration in the convey and the toners on the recording medium from being scratched off and from being adhered to the driven roller.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An image forming apparatus comprising an image forming portion for forming an image on a sheet-like recording medium and a convey member for conveying the sheet-like recording medium discharged from said image forming portion, said convey member is characterized by:

a driving roller;

a driven roller rotated while being pressed into contact with said driving roller; and an auxiliary rotary member fitted to at least one end of a shaft of said driven roller and rotated upon a contact with the sheet-like recording medium conveyed with rotations of said driving roller, for transmitting the rotations thereof to said driven roller.

2. An image forming apparatus according to claim 1, wherein said auxiliary rotary member has a diameter larger than that of said driven roller and is constructed of a member exhibiting a large friction.

3. An image forming apparatus according to claim 2, wherein said high frictional member is composed of a rubber rotary member.

4. An image forming apparatus according to any one of claims 1 to 3, wherein said auxiliary rotary member is formed in a configuration of an O-ring.

5. An image forming apparatus according to any one of claims 1 to 3, wherein said auxiliary rotary member is formed in a ring-like configuration which is angular in section.

6. An image forming apparatus according to any one of claims 1 to 3, wherein said auxiliary rotary member has a serrated rugged portion formed on an outer periphery thereof.

7. An image forming apparatus according to any one of claims 1 to 3, wherein said O-ring shaped auxiliary rotary member is fitted to one side of the shaft of said driven roller, and said sectionally angular ring-shaped auxiliary rotary member is fitted to the other side of the shaft of said driven roller.

8. An image forming apparatus according to any one of claims 1 to 3, wherein said O-ring shaped auxiliary rotary member is fitted to one side of the shaft of said driven roller, and said auxiliary rotary member formed with the serrated rugged portion is fitted to the other side of the shaft of said driven roller.

9. An image forming apparatus according to any one of claims 1 to 3, wherein said auxiliary rotary member is constructed such that said serrated rugged portions are provided in directions opposite to each other on right and left sides of the shaft of said driven roller.

10. An image forming apparatus according to any one of claims 1 to 3, wherein said auxiliary rotary member fitted to one side of the shaft of said driven roller is composed of a material exhibiting a higher frictional coefficient than that of said auxiliary rotary member fitted to the other side of the shaft of said driven roller.

11. An image forming apparatus according to claim 1, wherein said auxiliary rotary member has an outer diameter larger than that of said driven roller, and is fitted to one side of the shaft of said driven roller.

12. An image forming apparatus according to claim 11, wherein said auxiliary rotary member has a larger frictional coefficient than that of said driven roller.

13. A sheet conveying apparatus for discharging a sheet onto a tray, comprising:

a driving roller for discharging the sheet sent from a processing portion onto the tray;

a roller pressed into contact with said driving roller and rotated following to said driving roller; and an auxiliary rotary member, fitted to a shaft of said roller, disposed in a position not facing to said driving roller and having a diameter larger than that of said roller to be rotated following up the sheet conveyed, for transmitting the rotations thereof to said roller.

14. A sheet conveying apparatus according to claim 13, wherein said auxiliary rotary member has a larger frictional coefficient of the surface thereof than that of said roller.

15. A sheet conveying apparatus according to claim 13, wherein said auxiliary rotary member is composed of rubber.

16. A sheet conveying apparatus according to claim 13, wherein a plurality of said driving rollers and a plurality of said driven rollers are spaced away from each other in a sheet conveying direction, and at least one piece of said auxiliary rotary member is fitted to the shaft of each of said driven rollers.

* * * * *

UNITED STATES PATENT AND TRADEMARK OFFICE

CERTIFICATE OF CORRECTION

PATENT NO. : 6,089,567

DATED : July 18, 2000

INVENTOR(S): KAZUHIKO YATSUHASHI, ET AL.

It is certified that error appears in the above-identified patent and that said Letters Patent is hereby corrected as shown below:

COVER PAGE AT ITEM NO. [56] RC:
Foreign Patent Documents: "2144363" should read --2-144363--; and "3227875" should read --3-227875--.

COLUMN 1:
Line 32, "discharged" should read --discharged by--, and "roller" should read --rollers--;
Line 43, "and" should read --and be--; and
Line 54, "staked" should read --stacked--.

COLUMN 5:
Line 6, "of of" should read --of--.

COLUMN 6:
Line 4, "The many" should read --Many--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*